United States Patent [19]

Price

[11] Patent Number: 4,582,547

[45] Date of Patent: Apr. 15, 1986

[54] METHOD FOR IMPROVING THE ANNEALING SEPARATOR COATING ON SILICON STEEL AND COATING THEREFOR

[75] Inventor: LeRoy R. Price, Allison Park, Pa.

[73] Assignee: Allegheny Ludlum Steel Corporation, Pittsburgh, Pa.

[21] Appl. No.: 607,889

[22] Filed: May 7, 1984

[51] Int. Cl.[4] ..... H01F 1/04

[52] U.S. Cl. ..... 148/113; 148/27; 148/28

[58] Field of Search ..... 148/27, 28, 113

[56] References Cited

U.S. PATENT DOCUMENTS

| | | | |
|---|---|---|---|
| 3,379,581 | 4/1968 | Kohler et al. | 148/113 |
| 3,544,396 | 12/1970 | Taylor | 148/111 |
| 3,615,918 | 10/1971 | Evans | 148/113 |
| 3,956,029 | 5/1976 | Yamamoto et al. | 148/27 |
| 4,010,050 | 3/1977 | Choby | 148/27 |
| 4,113,530 | 9/1978 | Shimanaka et al. | 148/27 |
| 4,179,315 | 12/1979 | Miller | 148/113 |
| 4,200,477 | 4/1980 | Datta et al. | 148/113 |
| 4,255,205 | 3/1981 | Morito et al. | 148/113 |
| 4,287,006 | 9/1981 | Hiromae et al. | 148/27 |
| 4,344,802 | 8/1982 | Haselkorn | 148/27 |
| 4,443,425 | 4/1984 | Sopp et al. | 148/113 |

*Primary Examiner*—John P. Sheehan

*Attorney, Agent, or Firm*—Patrick J. Viccaro

[57] ABSTRACT

A method for producing an annealing separator coating on grain oriented silicon steel prior to final texture annealing to improve the coating uniformity and prevent oxidation of the steel surface during this annealing operation. The method comprises coating the steel with a conventional coating, such as magnesium oxide, having an addition of an inert, high temperature refractory annealing separator agent, preferably calcined alumina.

An annealing separator composition is also provided.

10 Claims, No Drawings

METHOD FOR IMPROVING THE ANNEALING SEPARATOR COATING ON SILICON STEEL AND COATING THEREFOR

BACKGROUND OF THE INVENTION

This invention relates to a method of improving the uniformity and quality of the base insulating coating on silicon-iron steel. More particularly, this invention relates to an annealing separator coating composition and a method of producing an annelaing separator coating on silicon-iron steel strip.

Such silicon steel or silicon-iron steel is useful for its electrical and magnetic properties and may include both oriented and nonoriented steels. In the production of such steels, an annealing separator coating may be used to improve the magnetic properties and prevent sticking of coil laps during heat treatment. Annealing separator coatings are particularly useful with grain oriented silicon steels.

Grain oriented silicon steel is used in various electrical applications, such as transformers and the like. The desired cube-on-edge grain orientation is produced during a final high temperature annealing operation. Prior to the annealing operation and after hot rolling, the steel is pickled, cold rolled to final gauge by a series of cold rolling operations with intermediate anneals, decarburized and then final high temperature annealed to achieve the desired secondary recrystallization and cube-on-edge texture. The secondary recrystallization is achieved by inhibiting primary grain growth during the stages of the annealing operation wherein this occurs. This is conventionally achieved by providing primary grain growth inhibitors, such as boron, manganese sulfides and aluminum nitrides.

Prior to final texture annealing, the steel is conventionally coated with an annealing separator coating, such as magnesium oxide. This coating may be applied in the form of a water slurry, or electrolytically, to the surfaces of the strip. The strip is then typically wrapped in coil form for annealing. Final texture annealing is performed at temperatures on the order of 2200° F. (1404° C.). The annealing separator coating prevents the convolutions of the coil from bonding together during the high temperature annealing treatment, and in addition reacts with the silica present on the surface of the sheet to form a strong forsterite insulating film. Also, the coating improves magnetic properties of the silicon steel by removing sulfur after secondary recrystallization has taken place. The sulfur acts as an inhibitor, like boron, to primary grain growth during texture annealing.

Moisture present in the magnesium oxide coating as magnesium hydroxide is liberated to cause transient oxidation of the steel surface as some of the iron is reacted therewith to form iron oxides. This results in irregular coating with the strip having uncoated areas, as well as deposits of reduced iron oxides on the surface of the strip. This poor surface quality impairs the performance of the steel in final electrical product applications.

Attempts have been made by others to improve the annealing separator coating. U.S. Pat. No. 3,544,396, issued Dec. 1, 1970, discloses adding 1 to 20% of chromic oxide ($Cr_2O_3$) by weight to a glass-forming magnesia annealing separator. The chromic oxide is an active additive which is disclosed to react with the silicon in the steel to form silica which reacts with the magnesia to form a more continuous silicate glass on the steel surface. The chromium metal is to diffuse into the silicon steel. Other additives, such as calcium oxide (CaO), are also disclosed to be reactive for the silicate glass formation.

U.S. Pat. No. 3,615,918, issued Oct. 26, 1971, relates to a method of producing an insulating glass coating using about 1–25% by weight of decomposable phosphate compounds in the annealing separator (magnesia) coating.

U.S. Pat. No. 3,956,029, issued May 11, 1976, discloses a magnesia annealing separator having an adjusted particle size distribution of the magnesia particles so as to provide the silicate glass formation and to maintain the friction between the steel sheets such as to prevent deformation of the steel during annealing. Magnesium compounds, as magnesium hydroxide, are disclosed as burned, to produce particles having a bulk density of between 0.18 and 0.30 g/cm$^3$ and a particle distribution of 40 to 70% not larger than 3 $\mu$m and not more than 15% of coarse particles larger than 15 $\mu$m.

It is, accordingly, a primary object of the present invention to provide a method for coating grain oriented silicon steel prior to final texture annealing wherein an improved coating is obtained and the adverse effects of liberated water are avoided.

Further, an object is to substantially eliminate the iron oxidation on the strip resulting from moisture between the coil laps.

It is also an object to improve the base coating development to provide better uniformity and quality of the coating.

This and other objects of the invention, as well as a more complete understanding thereof, may be obtained from the following description and specific examples.

SUMMARY OF THE INVENTION

In accordance with the present invention, a method is provided for producing an annealing separator coating on silicon steel prior to final texture annealing to improve coating uniformity and prevent oxidation of the steel surface during annealing. The method comprises applying to the steel a coating such as magnesium oxide having as an addition, an inert, high temperature refractory annealing separator agent in the form of particles.

An annealing separator composition is also provided comprising substantially magnesium oxide and an inert high temperature refractory annealing separator agent in particle form substantially within a size range of about 25 to 176 $\mu$m.

DETAILED DESCRIPTION OF THE PREFERRED EMBODMENTS

Broadly, in accordance with the invention, prior to final texture annealing the magnesium oxide coating applied to the steel has mixed therewith an inert, high-temperature refractory annealing separator agent in the form of particles. The agent takes no part in the base coating reaction between the silica on the surface of the sheet and the magnesium oxide in the coating; this reaction forms the desired insulating film or coating on the steel strip necessary for electrical insulation. The agent physically separates adjacent coil wraps to permit venting of the moisture liberated during the initial stages of heating in final texture annealing. Consequently, the liberated water is not available for reaction with the steel to form transient iron oxides.

Although calcined alumina has been demonstrated as an effective inert, high temperature refractory annealing separator agent, any inert material that is sufficiently refractory and hard to retain its particle form and inertness in the presence of the high temperatures incident to final texture annealing will be suitable. The particles must maintain a physical separation of adjacent coil wraps, thereby providing for venting of the liberated moisture. Examples of suitable materials include fully calcined zirconia ($ZrO_2$), chromic oxide ($Cr_2O_3$), magnesium oxide (MgO) and calcium oxide (CaO). Fully calcining materials is one way to achieve inertness, for purposes of the present invention, of otherwise active or reactive materials. The fully calcined refractory material, for example, has a greater bulk density than materials which have not been fully calcined, burned and sintered. For example, the calcined alumina used had a bulk density of about 0.90 to 1.10 g/cm$^3$.

It has been found that the addition of calcined alumina within the range of 2% to 20% by weight of the magnesia coating, on a water-free basis, preferably 5% to 10%, is effective for the purpose with about 7.5% being found effective. The amount of inert particles must be within a weight percent range which provides a sufficient number of particles to physically separate the coil laps to permit venting of excess moisture.

The magnesia coating of the present invention may be applied in accordance with conventional practices using conventional equipment. The method of applying the coating is not critical to the effectiveness of the annealing separator coating, as long as the inert agent particles are substantially evenly applied to the steel strip. Conventionally, the magnesia coating is applied by slurry coating, roller coating, dipping or electrostatically. After final texture annealing of the silicon steel with the magnesia separator coating thereon, the steel strip is typically "scrubbed" to remove the magnesia coating.

While particle size distribution of the inert particles does not appear to be critical, a range of particle sizes has been found to be important to the present invention. The inert agent should have a particle size substantially in the range of about 25 to 176 μm and, preferably, 60 to 100 μm. Typical particle size distribution of the range for two calcined alumina ($Al_2O_3$) powder sources used in MgO slurry coating is shown in Table I. Both aluminas have been used successfully and the size distribution was determined by the Leeds & Northrup Microtrack Particle Size Techniques.

TABLE I

ALUMINA PARTICLE SIZE IN "PERCENT FINER THAN"

| Size (μm) | Alumina A (%) | Alumina B (%) |
|---|---|---|
| 176 | 100 | 100 |
| 125 | 83.6 | 85.8 |
| 88 | 55.4 | 59.8 |
| 62 | 28.1 | 32.5 |
| 44 | 16.5 | 19.5 |
| 31 | 10.3 | 15.2 |
| 22 | 8.6 | 13.4 |
| 16 | 6.4 | 11.5 |
| 11 | 4.7 | 8.3 |
| 7.8 | 3.5 | 5.1 |
| 5.5 | 0.9 | 1.9 |
| 3.9 | 0.3 | 0.9 |
| 2.8 | 0.0 | 0.3 |

It appears that the upper limit of the particle size is somewhat dependent on the manner in which the coating is to be applied. Preferably, a substantial amount have particle size not exceeding about 100 μm. It has been found that larger particle sizes are more difficult to keep in suspension in the magnesia coating and thus more difficult to apply to the steel. In typical slurry coating operations, particles up to about 100 μm can be kept in suspension and applied using conventional equipment and techniques. Fully calcined magnesium oxide powder having a substantial particle size range of greater than 100 μm was found to be ineffectual. The particles could not be applied uniformly because they fell out of suspension.

Preferably, a substantial amount of particles have a minimum size of about 60 μm in order to physically separate the coil laps. The MgO coating thickness varies somewhat and is friable and compressible. It appears that the particle size should be on the order of the coating thickness or more to be effective to separate the coil laps to permit venting of the moisture. For example, the MgO coating may have a nominal thickness on the order of 10 to 20 μm on each side of the strip. In coil form, the coil laps would be separated by two coating thicknesses, i.e., approximately 20 to 40 μm. For purposes of the present invention, the inert particles would have a minimum size of from 20 to 40 μm in order to separate the coil laps. It should be understood that these coating thickness values are only exemplary, for they are dependent on variables such as density of the MgO coating and the actual coating thickness applied.

In order to more completely understand the invention, the following examples are presented.

EXAMPLES

As specific examples of the practice of the invention, extended tests were performed with grain oriented silicon steel coils in sheet thickness of both 9 mil and 11 mil. The nominal composition for the silicon steel in weight percent is 3.25 silicon, 0.070 manganese, 0.025 sulfur, 0.030 carbon, and balance iron. In these extended tests, the coils of the present invention were slurry coated with 7.5% by weight calcined Alumina A of Table I on a water-free basis in a conventional MgO coating and for comparison, control coils of conventional MgO slurry coating wherein no alumina was used were employed. Table II shows the summary of weekly rejection or "scrub" performance for the coatings having the calcined alumina addition in comparison with control coils having coatings without the calcined alumina addition. Rejections were based on the poor surface quality of the forsterite insulating coating due to uncoated areas and iron oxide deposits.

TABLE II

POOR COATING REJECTIONS

| | 9-Mil Thickness | | 11-Mil Thickness | |
|---|---|---|---|---|
| Rejections | Control | With Alumina | Control | With Alumina |
| No. Rejected | 347 | 14 | 179 | 8 |
| Total Coils | 548 | 218 | 427 | 152 |
| Percent | 63.3 | 6.4 | 41.9 | 5.3 |

As may be seen from Table II, 9-mil coils coated with the annealing separator coating containing calcined alumina in accordance with the invention showed a rejection percentage of 6.4% as compared with 63.3% for the coils of the same silicon steel wherein the annealing separator coating was of the same coating thickness but did not contain calcined alumina. The results are similar with respect to the 11-mil coated material wherein the alumina-containing separator coating provided a rejection percentage of 5.3% as compared with 49.9% for the coils coated with an annealing separator not having the addition thereof of calcined alumina.

When the control coils (wherein no alumina addition was made to the annealing separator coating) and the coils coated in accordance with the invention (wherein the annealing separator had 7.5% calcined alumina therein) were compared with regard to magnetic properties, no significant difference was determined with regard to the coils coated with 7.5% calcined alumina in the annealing separator. Table III shows magnetic properties data for the 9-mil and 11-mil control coils, and coils processed in accordance with the present invention. The data is for the poor end of the coil, but the comparison is applicable to the good end also.

TABLE III

POOR END MAGNETIC PROPERTIES

| | | 9 Mil Thickness | | 11 Mil Thickness | |
|---|---|---|---|---|---|
| | | Control | With Alumina | Control | With Alumina |
| Core Loss (WPP @ 17 KB) | | .669 | .666 | .701 | .703 |
| Percent | ≦0.63 | 13 | 11 | — | — |
| | ≦0.67 | 60 | 63 | — | — |
| | ≦0.68 | — | — | 30 | 27 |
| | ≦0.71 | 90 | 93 | 72 | 69 |
| | ≦0.74 | — | — | 89 | 95 |
| Permeability @ 10 H | | 1830 | 1834 | 1834 | 1832 |
| Percent | <1800 | 7 | 5 | 3 | 1 |
| | ≧1830 | 63 | 66 | 69 | 63 |
| | ≧1840 | 41 | 48 | 49 | 42 |

Consequently, the addition of calcined alumina is an inert, high temperature refractory separator agent to a conventional annealing separator coating in accordance with the invention does not adversely affect the magnetic properties.

As was an object of the present invention, a method and annealing separator coating is provided for improving the quality and uniformity of the insulating coating of silicon steel. Further advantages of the invention are that there is no loss is magnetic quality and that the present invention is readily adaptable into conventional manufacturing equipment and processes. Furthermore, it has been found that the improved overall surface quality and smoothness represents a reduction in the coefficient of static friction as demonstrated by a conventional test, such as the General Electric Modified Friction Test. Still further, the addition of inert particles, such as calcined alumina, is cost effective for improvement in surface quality by reduction of defects in the coating.

While several preferred and alternative embodiments of the invention have been shown and described, it will be apparent to those skilled in the art that modifications may be made therein without departing from the scope of the present invention.

What is claimed is:

1. A method for providing an annealing separator coating on cold-rolled silicon steel prior to final texture annealing the steel in coil form to improve base coating uniformity and prevent oxidation of the steel surface during annealing, said method comprising applying to said steel the separator coating having an addition to said coating of an inert, high temperature refractory annealing separator agent in particle form in an amount within the range of 2 to 20 percent by weight of coating on a water-free basis, substantially evenly applied to the steel surface and having a particle size substantially within the range of about 25 to 176 μm and greater than the coating thickness between coil wraps to separate the coil wraps during annealing.

2. The method of claim 1 wherein said inert annealing separator agent is selected from the group consisting of fully calcined alumina, zirconia, chromic oxide, magnesium oxide and calcium oxide.

3. The method of claim 1 wherein calcined alumina is present in an amount of about 7.5 percent by weight of coating on a water-free basis.

4. The method of claim 1 wherein said inert agent has a particle size substantially within the range of about 60 to 100 μm.

5. A method for providing an annealing separator coating on cold-rolled grain oriented silicon steel prior to final texture annealing in coil form to improve base coating uniformity and prevent oxidation of the steel surface during annealing, said method comprising applying to said steel a magnesium oxide coating having an addition to said coating of an inert, high temperature refractory annealing separator agent in an amount within the range of 2 to 20 percent by weight of coating on a water-free basis and having a particle size substantially within the range of about 25 to 176 μm to separate the coil wraps to permit venting of moisture evolved during annealing.

6. The method of claim 5 wherein said inert, high temperature refractory annealing separator agent is calcined alumina.

7. The method of claim 5 wherein said inert agent is selected from the group consisting of fully calcined alumina, zirconia, chromic oxide, magnesium oxide and calcium oxide.

8. An annealing separator composition for coating silicon steel sheet comprising substantially magnesium oxide and an inert, high temperature refractory annealing separator agent in particle form and having a particle size substantially within the range of about 25 to 176 μm and having the inert agent in an amount within the range of 2 to 20 percent by weight of the coating on a water-free basis.

9. The annealing separator composition of claim 8 wherein the inert particle agent is selected from the group consisting of fully calcined alumina, zirconia, chromic oxide, magnesium oxide and calcium oxide.

10. The annealing separator composition of claim 8 wherein the inert agent particle agent size substantially ranges from about 60 to 100 μm.

* * * * *